US005508794A

United States Patent [19]

Ikesue et al.

[11] Patent Number: 5,508,794

[45] Date of Patent: Apr. 16, 1996

[54] DEVELOPER RECYCLING SYSTEM AND DEVELOPER CARTRIDGE THEREFOR

[75] Inventors: Masumi Ikesue, Tokyo; Takeshi Iijima, Yokohama; Yuichi Ueno, Kawasaki; Shigekazu Enoki, Kawasaki; Atsushi Kawamura, Yokosuka; Michihito Ohashi, Kawasaki, all of Japan

[73] Assignee: Ricoh Company, Ltd., Tokyo, Japan

[21] Appl. No.: 205,175

[22] Filed: Mar. 3, 1994

[30] Foreign Application Priority Data

Mar. 3, 1993 [JP] Japan ..... 5-069262
Apr. 27, 1993 [JP] Japan ..... 5-100653

[51] Int. Cl.[6] ..... G03G 15/08

[52] U.S. Cl. ..... 355/260; 118/653; 355/245

[58] Field of Search ..... 355/260, 245, 355/298; 222/DIG. 1; 118/652, 653, 657–658

[56] References Cited

U.S. PATENT DOCUMENTS 4,389,968 6/1983 Satomura ..... 118/652
4,614,165 9/1986 Folkins et al. ..... 118/657
4,825,244 4/1989 Hediger ..... 118/653 X
4,885,223 12/1989 Enoki et al. ..... 430/122
4,899,690 2/1990 Hacknauer et al. ..... 118/653
5,077,583 12/1991 Bhagat ..... 355/251
5,109,254 4/1992 Oka et al. ..... 355/200
5,307,128 4/1994 Murasaki et al. ..... 355/260

FOREIGN PATENT DOCUMENTS 0002881 1/1991 Japan ..... 355/260

*Primary Examiner*—A. T. Grimley
*Assistant Examiner*—Thu Dang
*Attorney, Agent, or Firm*—Oblon, Spivak, McClelland, Maier & Neustadt

[57] ABSTRACT

A developer recycling system is provided for replenishing a fresh developer to a developing device of an image forming apparatus and collecting it after use. A developer cartridge applicable to the system is also provided. When the fresh developer is replenished from the cartridge to the developing device, a developer existing in the developing device overflows in an amount corresponding to the replenished developer. The developer overflown the developing device is recirculated to the cartridge and reused.

25 Claims, 9 Drawing Sheets

DEVELOPER RECYCLING SYSTEM AND DEVELOPER CARTRIDGE THEREFOR

BACKGROUND OF THE INVENTION

The present invention relates to a system for replenishing a fresh developer to a developing device of an image forming apparatus and collecting a used developer, and a developer cartridge for such a system.

A copier, facsimile apparatus, laser printer or similar electrophotographic image forming apparatus includes a developing device which stores a developer and develops an electrostatic latent image formed on a photoconductive drum or similar image carrier with the developer. As the developing device repeats development, a toner contained in the developer is sequentially consumed with the result that the toner concentration of the developer becomes too low to form desired images. Therefore, it has been customary to provide the developing device with a developer replenishing device for replenishing a fresh developer in matching relation to the decreasing toner concentration. One of modern developer replenishing devices uses a developer cartridge, or toner cartridge as generally referred to, containing only a toner, i.e., one-component developer or a toner and carrier mixture, i.e., two-component developer.

It has also been customary to provide the developing device with a device for collecting a toner removed from the image carrier together with various impurities and discarding them. Usually, this collecting device is implemented as a container physically separate from the above-stated developer cartridge. This kind of configuration has a drawback that the overall size of the developing device increases. Moreover, when the developer cartridge and the container for collection are erroneously replaced, the developer flows out of the cartridge and contaminates surroundings.

To eliminate the above problems, Japanese Patent Laid-Open Publication No. 56-146171 discloses a photoconductive drum provided with a fresh toner container and a collected toner container which are formed integrally with each other with the intermediary of a partition. With this drum, it is possible to replenish a fresh toner and collect a used or waste toner automatically. In addition, the supply of a fresh toner and the disposal of a waste toner are effected at the same time when the drum is replaced, reducing maintenance work. This kind of approach, however, brings about another problem that the drum has to be replaced every time the toner is replaced, and the replacement of the drum is apt to damage the drum.

Japanese Patent Laid-Open Publication No. 2-33169 teaches a toner cartridge having a fresh toner compartment and a collected toner compartment separated from each other by a partition. The partition is formed with an opening in an upper portion thereof. A valve is provided in the opening and allows a toner to pass therethrough only from the collected toner compartment to the fresh toner compartment. Japanese Patent Laid-Open Publication No. 62-84049 proposes a toner cartridge having a fresh toner container and a waste toner container which are joined together by a separable member. Further, U.S. Pat. No. 4,744,493 discloses a toner container having a spiral configuration.

Other devices for toner collection are taught in Japanese Patent Laid-Open Publication Nos. 60-10274, 61-2172, 61-2173, 63-298370, 60-146265, and 61-9666. However, with such conventional devices, it is necessary to replace a container or tank for collecting the waste developer, including the toner, periodically, resulting in troublesome .operation. To reduce the frequency of such periodic replacement, the container or tank itself has to be provided with a large capacity, increasing the overall size of the developing device. Moreover, when the developer is to be collected in the container or tank, the toner contained therein is scattered around to contaminate the interior of the developing device.

The troublesome replacement of the developer cartridge and the container or tank for collecting the used developer will be obviated if the developer used and then collected is recirculated for reuse. However, practical schemes for implementing the recirculation have not been reported yet.

SUMMARY OF THE INVENTION

It is, therefore, an object of the present invention to provide a developer recycling system capable of replenishing a fresh developer to a developing device and collecting a used developer at the same time.

It is another object of the present invention to provide a developer cartridge applicable to a developer recycling system for effecting the replenishment of a fresh developer to a developing device and the collection of a used developer at the same time.

In accordance with the present invention, a developer recycling system for replenishing a fresh developer to a developing device and collecting a used developer comprises a developer cartridge filled with the fresh developer, and a developer recirculating device for recirculating, when the fresh developer is replenished into the developing device in response to a decrease in the density of the developer, the developer which overflows the developing device to the developer cartridge.

Also, in accordance with the present invention, a developer cartridge capable of replenishing a fresh developer to a developing device and collecting the developer from the developing device at the same time comprises a container for replenishing the fresh developer to the developing device, and a receptacle formed integrally with the container for collecting the developer. The container and the receptacle each comprises a hollow cylindrical container formed with a spiral ridge on inner periphery thereof, a developer inlet at one end, and a developer outlet at the other end. The receptacle is received in the container in a double layer structure such that the receptacle and container are rotatable integrally about a substantially common axis.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
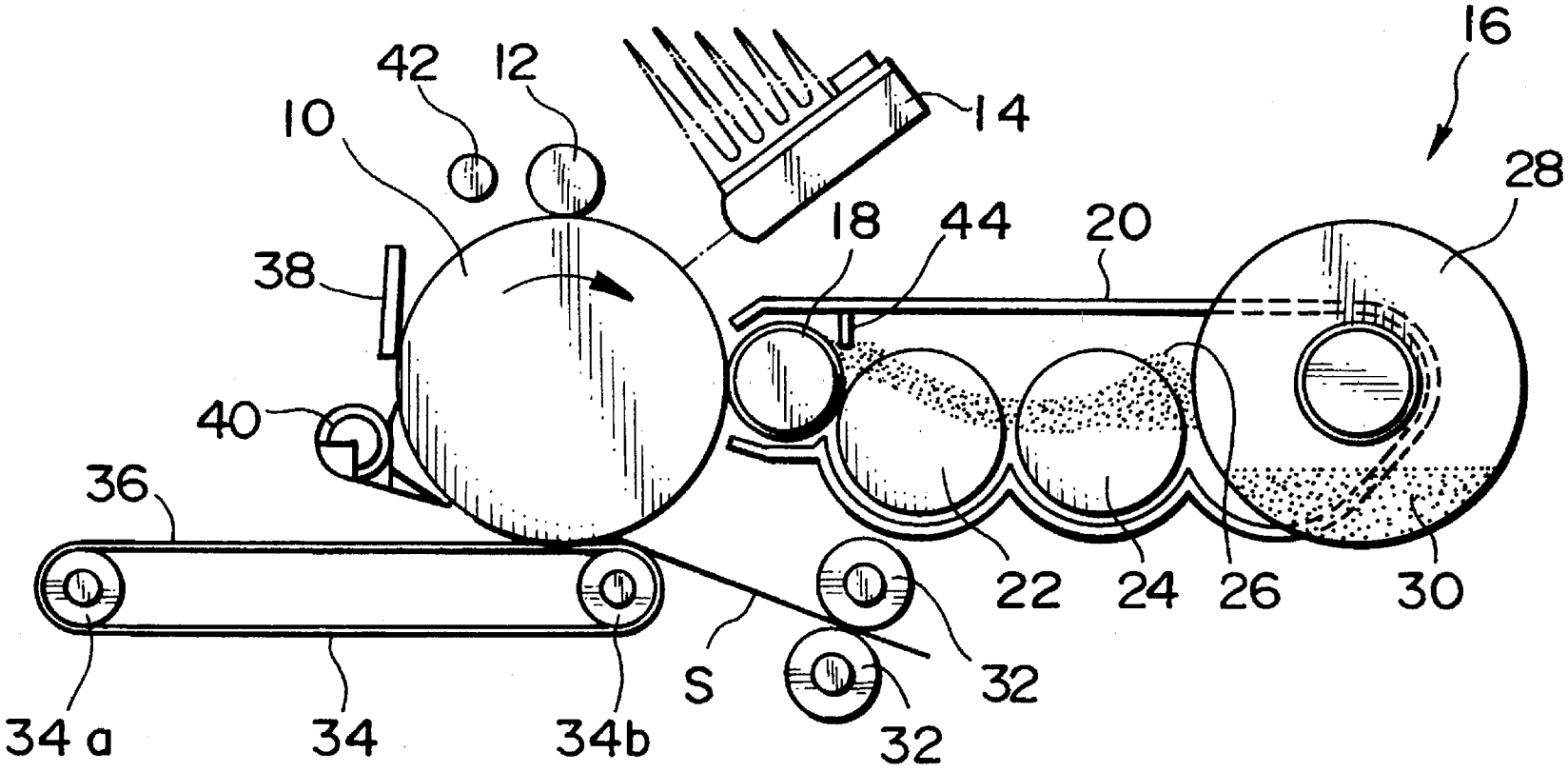
FIG. 1 is a section of an electrophotographic copier to which a developer recycling system of the present invention is applicable.

Referring to FIG. 1 of the drawings, there are shown a developing device to which a developer recycling system of the present invention is applied, and an image forming apparatus having the developing device. The image forming apparatus is implemented as an electrophotographic copier by way of example. As shown, the copier has an image carrier in the form of a photoconductive drum 10. The drum 10 is uniformly charged by a charge roller 12 and then exposed imagewise by an LED (Light Emitting Diode) array 14 which plays the role of a writing device. As a result, a latent image is electrostatically formed on the drum 10. A developing device, generally 16, includes a developing roller 18. A magnet brush is formed on the developing roller 18 and develops the latent image to produce a corresponding toner image. Specifically, the magnet brush is formed by a developer 26 which is agitated and circulated by a first and a second agitator roller 22 and 24 also included in the developing device 16. A developer cartridge, i.e., toner cartridge 28 is removably mounted on a casing 20 further included in the developing device 16. The toner cartridge 28 contains a fresh two-component type developer, i.e., toner and carrier mixture 30. The fresh developer 30 is replenished from the cartridge 28 into the casing 20. As a sheet S is fed to the drum 10 via a registration roller pair 32, an image transfer unit 34 transfers the toner image from the drum 10 to the sheet S. The image transfer unit 34 has an endless belt 36 passed over drive rollers 34a and 34b. The sheet S carrying the toner image thereon is conveyed by the belt 36 to a fixing unit, not shown, to have the toner image fixed thereby. After the image transfer, a cleaning blade 38 removes the toner remaining on the drum 10 and delivers it to a collecting device, not shown. Subsequently, a discharger 42 dissipates the charge also remaining on the drum 10. As a result, the drum 10 is prepared for another image forming cycle beginning with the uniform charging step. If desired, a doctor blade 44 may be mounted on the inner periphery of the casing 20 above the developing roller 18 so as to regulate the density of the developer deposited on the developing roller 18, i.e., the thickness of the magnet brush.

Figure 2:
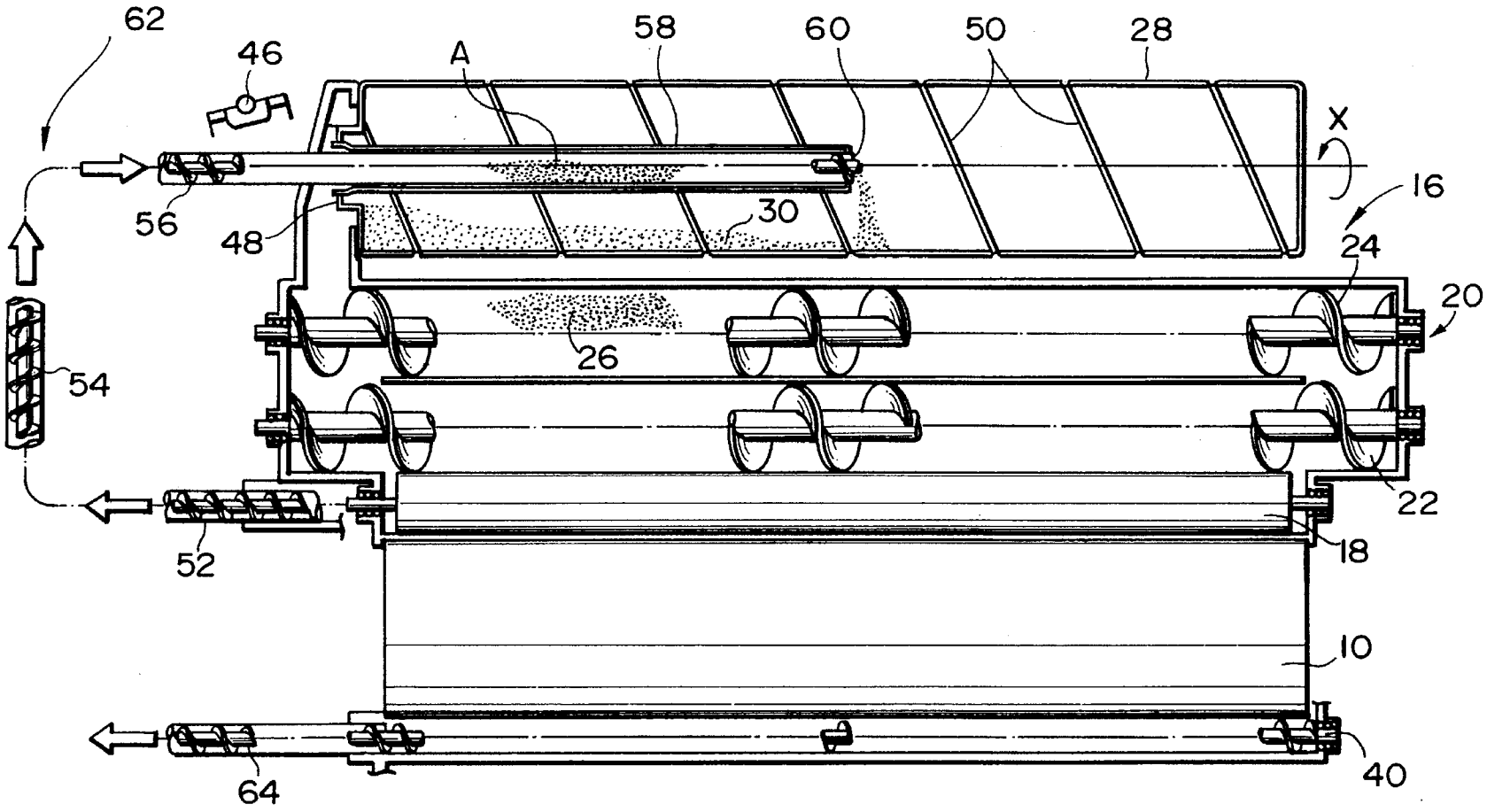
FIG. 2 is a section of a developer recycling system embodying the present invention.

A developer recycling system embodying the present invention will be described with reference to FIG. 2. In FIG. 2, the same constituent parts as the parts shown in FIG. 1 are designated by the same reference numerals, and a detailed description thereof will not be made in order to avoid redundancy. As shown, the toner cartridge 28 has an outlet, or mouth, 48 which is usually closed by a cap 46. When the cap 46 is removed from the cartridge 38, the developer 30 is fed into the casing 20 via the outlet 48. Specifically, the cartridge 28 has a hollow cylindrical configuration and is formed with an inwardly protruding spiral groove 50. When the cartridge 28 is bodily rotated about its own axis, as indicated by an arrow X in the figure, the developer 30 is sequentially replenished into the casing 20 via the outlet 48 of the cartridge 28. An arrangement is made such that as the fresh developer 30 is fed into the casing 20 from the cartridge 28, a developer 26 existing in the casing 20 overflows in an amount corresponding to the fresh developer 30. The developer overflown the casing 20, labeled A in the figure, is delivered to a screw conveyor 52 which defines a first conveyance path. Subsequently, the developer A is routed through a second conveyance path 54 to a third conveyance path 56 which is partly inserted in the cartridge 28. The third conveyance path 56 drives the developer A into a tubular receptacle 58 having an outlet 60 at the deepest end thereof. As a result, the developer A is returned to the cartridge 28 via the outlet 60 of the receptacle 58. The screw 52 and second and third conveyance paths 54 and 56 constitute a developer recirculating device 62 in combination. The developer 26 (i.e., toner, carrier and fresh developer 30) are circulated in the casing 20. Another conveyance path 64 is connected to the screw conveyor 40 and assigned to a cleaning toner.

The tubular receptacle 58 extends in and along the axis of the cartridge 28 and is coupled with the third conveyance path 56. In this configuration, the overflown developer A is recirculated into the cartridge 28 at substantially the center of the cartridge 28. When the cartridge 28 is rotated about the axis thereof, the developer A flows into the cartridge 28 via the outlet 60 of the receptacle 58.

Hereinafter will be described why this embodiment has the developer recirculating or recycling means 62, i.e., why it reuses a collected or used developer, in contrast with conventional systems which prevent a collected developer from being mixed with a fresh developer. With the progress of technologies for producing developers, particularly toners, a toner of uniform particle size can be easily produced today. Since a uniform particle size means a uniform physical property, it is possible to lower, for example, the pressure to be exerted by the cleaning blade 38. In this condition, the probability that the toner collected by the blade 38 is physically broken or aggregated is reduced. This, in turn, promotes easy separation in the event of toner collection and protects images from noticeable degradation. This is why the embodiment recycles the developer, i.e., toner.

The operation of the developer recirculating device 62 will be described specifically. The carrier concentration of the fresh developer contained in a single cartridge 28 is selected, in weight percent, such that the developer 26 does not deteriorate even when the number of copies available with the amount of toner existing in the cartridge 28 are continuously produced. The overflown developer A is routed through the first, second and third conveyance paths 52, 54 and 56 and tubular receptacle 58 to the outlet 60, as stated earlier. As a result, when the casing 20 has run out of toner, i.e., in a toner end condition, the developer A is held in the cartridge 28. After the image transfer from the drum 10 to the sheet S, the toner collected in the cleaning toner path 64 via the screw 40 is stored in a container, not shown.

As stated above, since the developer 26 in the casing is recirculated to the cartridge 28 via the recirculating device 62 in an amount corresponding to the fresh developer 30 replenished into the casing 20. As a result, a predetermined amount of developer 26 is automatically replaced when the cartridge 28 is replaced, making it needless to replace the developer 26 periodically. Moreover, the cartridge 28 is implemented as a hollow cylindrical member having the spiral groove 50 on the inner periphery thereof, while the recirculation path in the cartridge 28 terminates at the axis of rotation of the cartridge 28. This realizes the automatic replacement of the developer 26 without obstructing the replenishment of the toner or sacrificing the volume of toner or easy operation.

Figure 3:
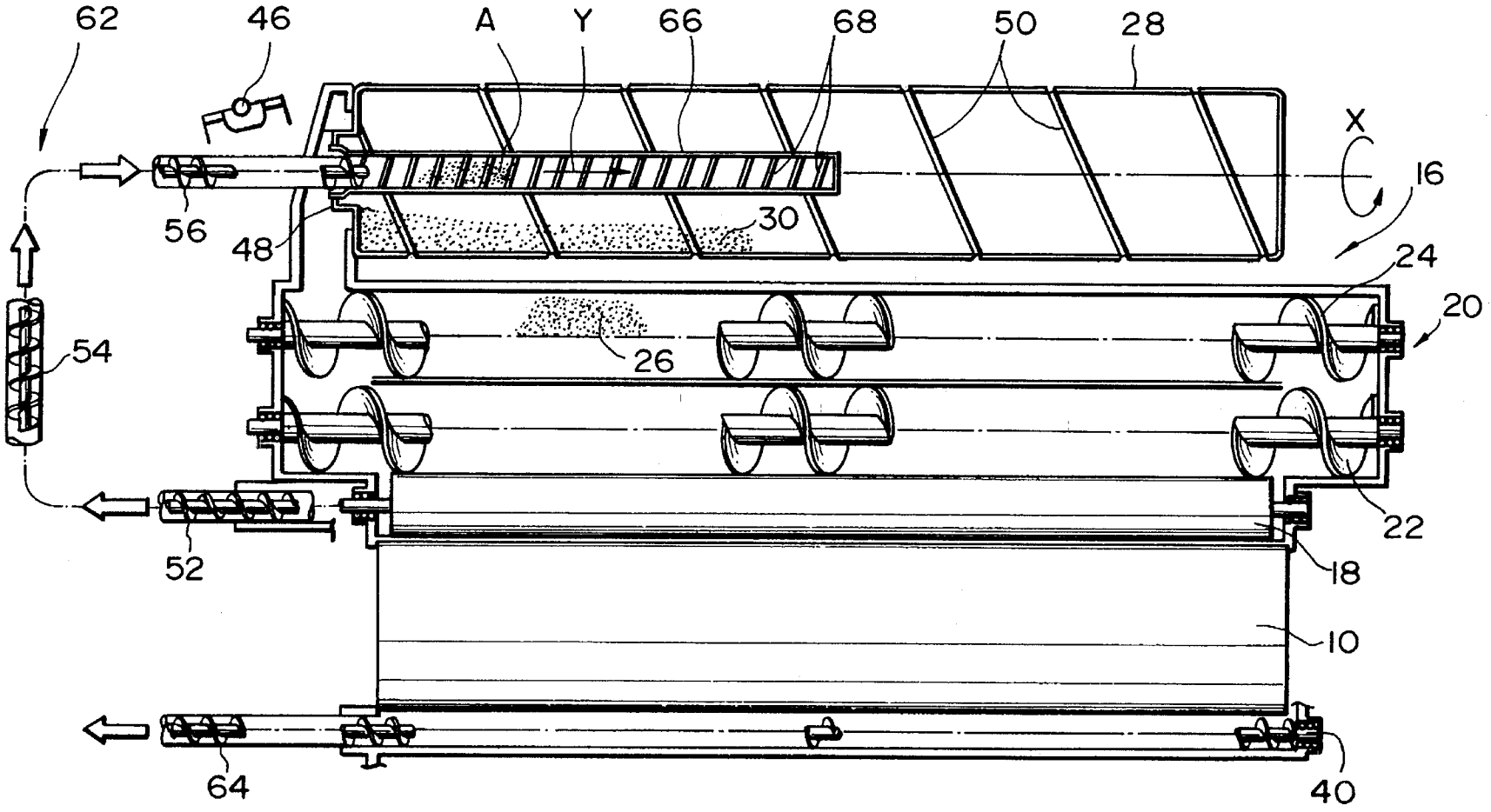
FIGS. 3 and 4 are sections each showing an alternative embodiment of the system in accordance with the present invention.

FIG. 3 shows an alternative embodiment of the recycling system in accordance with the present invention. In FIG. 3, the same or similar constituent parts as or to the parts shown in FIGS. 1 and 2 are designated by the same reference numerals, and a detailed description thereof will not be made in order to avoid redundancy. As shown, this embodiment is essentially similar to the previous embodiment except for the configuration of the tubular receptacle following the third conveyance path 56. Specifically, a tubular receptacle 66 extends in and along the axis of the cartridge 28 so as to trap the developer recirculated into the cartridge 28 by the recirculating device 62. The receptacle 66 has a volume great enough to accommodate the recirculated developer and is formed with an inwardly protruding spiral groove 68. The spiral groove 68 is opposite in direction to the spiral groove 50 of the cartridge 28. If desired, the spiral groove 50 may be replaced with a spiral metallic wire fitted on the inner periphery of the receptacle 66.

In operation, the developer A overflown the casing 20 is recirculated into the tubular receptacle 66 via the third conveyance path of the recirculating device 62. As the cartridge 28 is rotated in the direction X, the developer A advances in a direction Y in which the groove 68 extends. Finally, the receptacle 66 accommodates the developer 26 corresponding in amount to the fresh developer 30. Hence, when the entire cartridge 28 is replaced, the receptacle 66 and, therefore, the developer existing therein is replaced at the same time.

As stated above, the developer recirculated by the recirculating device 62 is collected in the independent tubular receptacle 66. This prevents the fresh developer 30 form being mixed with the recirculated developer and, therefore, surely implements the automatic replacement of the developer A. The groove 68 of the receptacle 66, which is opposite in direction to the groove 50 of the cartridge 28, allows the receptacle 66 to have a small diameter and a great capacity.

Figure 4:
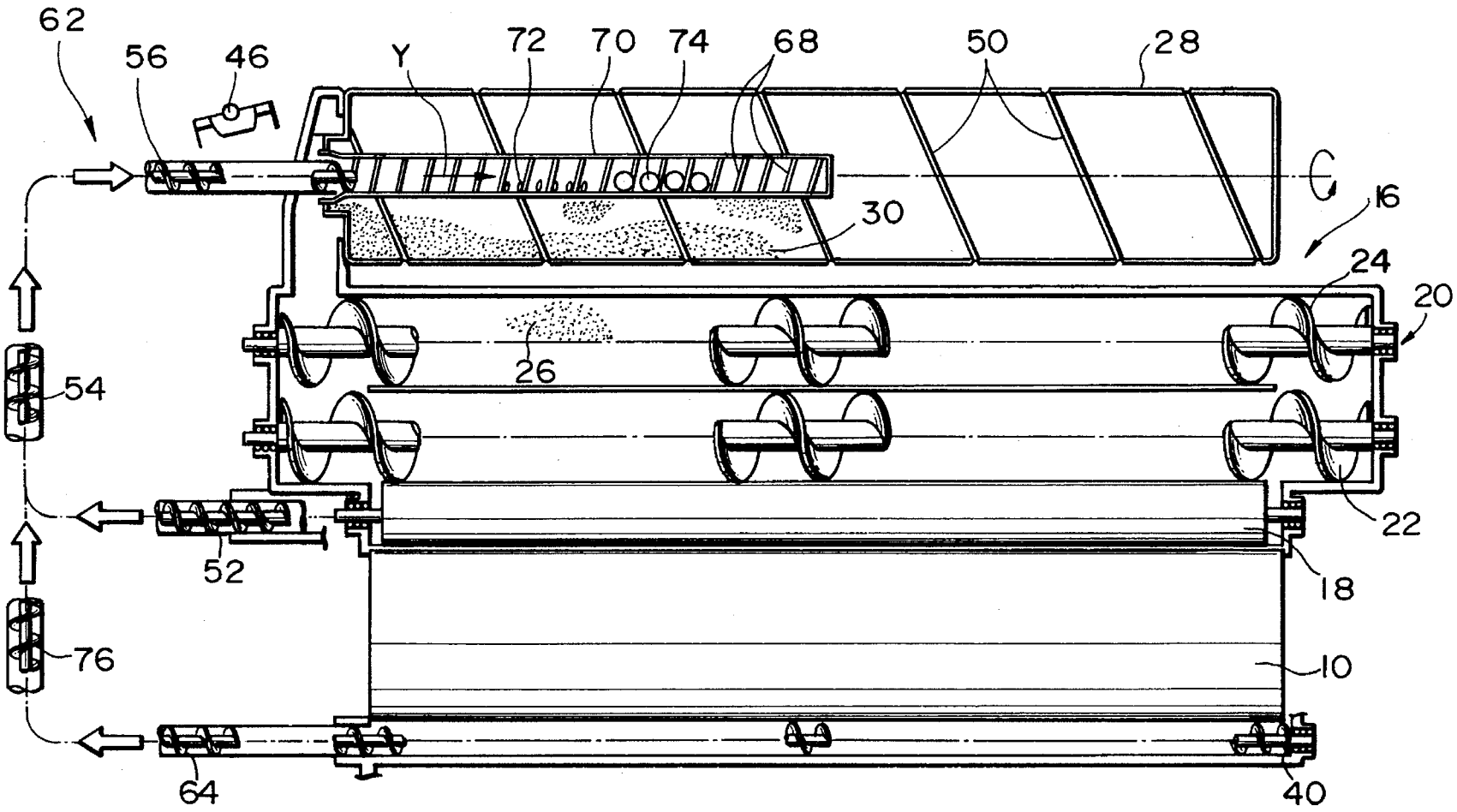

A reference will be made to FIG. 4 for describing another alternative embodiment of the recycling system in accordance with the present invention. In FIG. 4, the same or similar constituent parts as or to the parts of FIG. 1–3 are designated by the same reference numerals, and a detailed description thereof will not be made in order to avoid redundancy. As shown, the embodiment has a tubular receptacle 70 implemented as a mesh having a great number of micropores, not shown. The micropores of the receptacle 70 are sized to trap, among the recirculated developer particles 26, carrier particles greater than a predetermined particle size, but to pass toner particles smaller than a predetermined particle size and not obstructing normal image formation. The receptacle 70 is made up of two parts which are easily removable from the cartridge 28. A desiccant 72 is accommodated in the receptacle 70 for absorbing moisture from the recirculated carrier and toner. Also accommodated in the receptacle 70 are balls 74 for loosening the recirculated developer.

A fourth conveyance path 76 extends from the cleaning toner conveyance path 64 and terminates at the second conveyance path 54. In this configuration, not only the developer from the screw conveyor 52 but also the developer left after image transfer are collected in the receptacle 70. In this sense, the recirculating device 62 is made up of the screw 52 and first to fourth conveyance paths 54, 56 and 76. Specifically, even the toner remaining on the belt 36 after image transfer is collected and reused via the fourth conveyance path 76.

In the illustrative embodiment, the overflown developer 26 is collected in the receptacle 70 via the third conveyance path 56 as the developer A. The developer A advances in the direction Y due to the spiral groove 68. At this instant, sufficiently small toner particles feasible for reuse are let fall into the cartridge 28 through the micropores of the receptacle 70. On the other hand, the carrier particles, impurities including paper dust, and fatted toner particles are filtered out and retained in the receptacle 70. Finally, when the cartridge 28 is replaced, the receptacle 70 is replaced at the same time. Therefore, the embodiment not only reuses the toner but also collects the above-mentioned undesirable particles. The desiccant 72 may be implemented by silica gel or grains of rise by way of example. The balls 74 promote the passage of the toner particles through the wall of the receptacle 70 and may be constituted by, for example, metal balls or glass balls.

As described above, the receptacle, or tubular mesh, 70 returns small toner particles into the cartridge 28 while trapping the carrier particles and fatted toner particles. Hence, every time the cartridge 28 is replaced due to atoner end condition, the developer in the casing 20 is only partly replaced with a fresh developer, and most of the discharged developer can be reused. This is successful in enhancing efficient reuse of the developer. Further, the desiccant 72 in the receptacle 70 absorbs moisture from the recirculated carrier and toner and, in addition, from the fresh developer 30, thereby improving the fluidity and electrostatic property of the toner.

Figure 5:
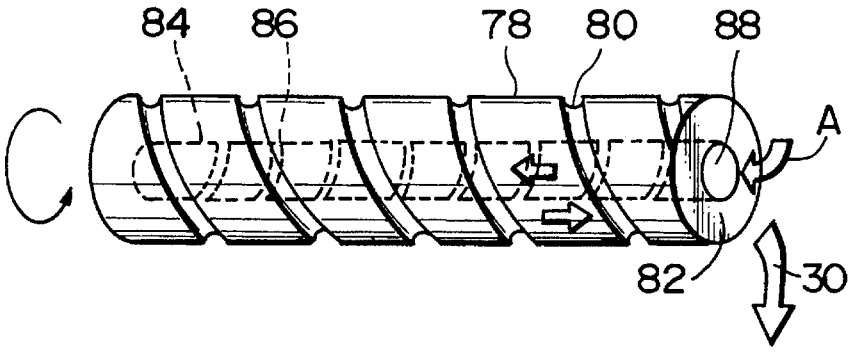
FIG. 5 shows another alternative embodiment of a toner cartridge and a receptacle for collection which are applicable to the developer recycling system of the present invention.
Figure 6:
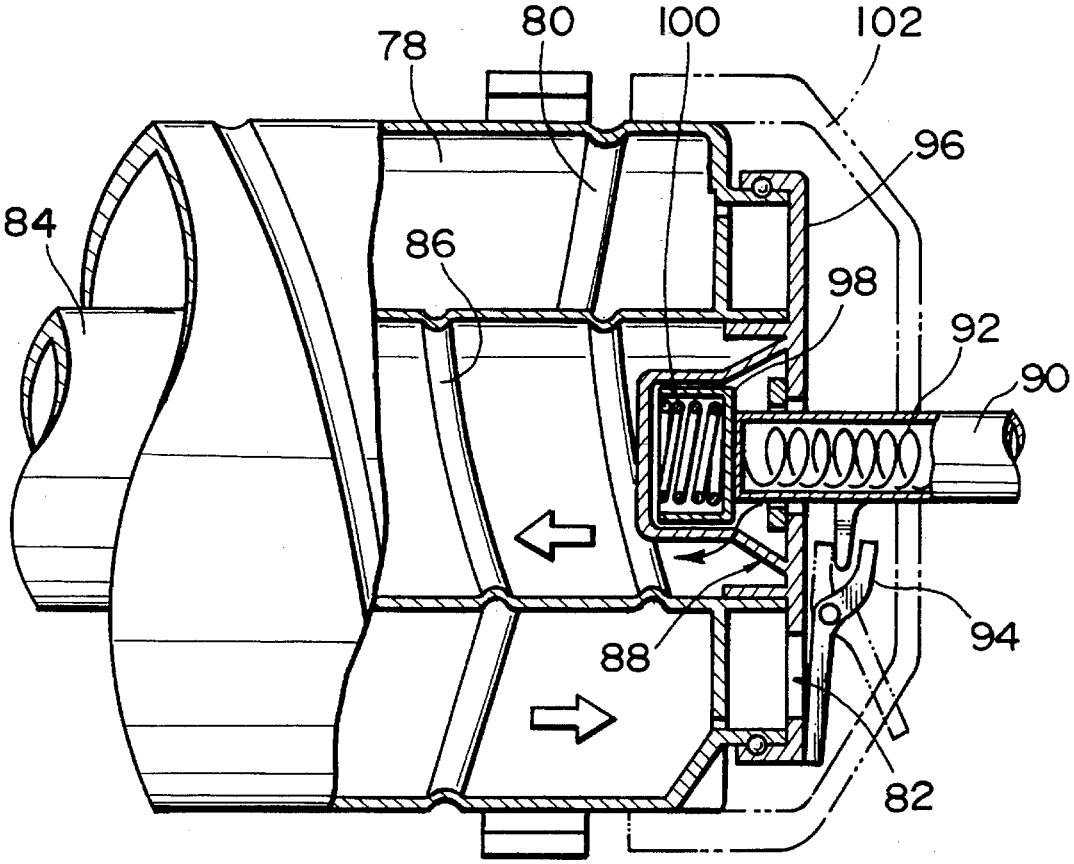
FIG. 6 is a fragmentary section associated with FIG. 5.

Referring to FIGS. 5 and 6, another specific configuration of the toner cartridge is shown. As shown, the cartridge, generally 78, has a spiral ridge 80 on the inner periphery and an outlet, or mouth, 82 at one end. A tubular receptacle 84 is received in the cartridge 78 and formed with a spiral ridge 86 on the inner periphery thereof. An inlet 88 is formed at one end of the receptacle 84. The cartridge 78 and receptacle 84 are joined in a substantially coaxial double-layer structure and rotatable integrally with each other, as in the previous embodiments. The spiral ridge 80 is opposite in direction to the spiral ridge 86. The outlet, or inlet in the event of filling up, 82 of the cartridge 78 and the inlet 88 of the receptacle 84 are positioned at the same axial end of the assembly. The other end of the cartridge 78 is fully closed, but the other end of the receptacle 84 is perforated and communicated to the interior of the cartridge 78.

The configuration described above replenishes a fresh developer and collects the used developer at the same end of the cartridge and receptacle assembly. Specifically, when the cartridge 78 is rotated, the fresh developer is fed out from the cartridge 78 while, at the same time, the used developer is driven into the receptacle 84. In the illustrative embodiment, the replenishing and collecting end of the cartridge and receptacle assembly is positioned at the rear portion of the developing device, thereby preventing the toner from being scattered around in the event of replacement.

The assembly of FIG. 5 is shown in FIG. 6 in detail. There are shown in the figure a developer collecting member 90, a conveyor member 92, an opening/closing member 94, a cover member 96, an inner lid 98, a spring or similar biasing member 100, and a copier body 102. When the cartridge 78 is mounted to the copier body 102, the opening/closing member 94 opens the outlet 82 of the cartridge 78 by being pressed by the copier body 102. At the same time, the cover member 96 is locked to the developing device. In this condition, the outlet 82 of the cartridge 78 is aligned with an inlet formed in the developing device. When the cartridge 78 is rotated, a fresh toner filling the cartridge 78 is sequentially transferred toward the outlet 82 and then transferred to the developing device. The collecting member 90 is affixed to the copier body 102. When the cartridge 78 is mounted to the copier body 102, the biasing member 100 forces the inner lid 98 to open with the result that the inlet 88 of the receptacle 84 is uncovered. Therefore, the developer conveyed by the collecting member 92 is driven into the receptacle 84 via the inlet 88. The collected developer is introduced into the cartridge 78 at the other end of the receptacle 84 and again transferred to the developing device via the outlet 82 of the cartridge 78. In FIG. 6, broad arrows indicate the directions in which the developer are conveyed.

The spiral ridges 80 and 86 of the cartridge 78 and receptacle 84, respectively, replace a conventional auger or similar conveyor member. Specifically, only if the cartridge 78 and receptacle 84 are rotated integrally with each other, they can replenish a fresh toner and, at the same time, feed the collected toner to the developing device smoothly. In addition, the cartridge and receptacle assembly has substantially the same axial dimension as a conventional toner cartridge.

Figure 7:
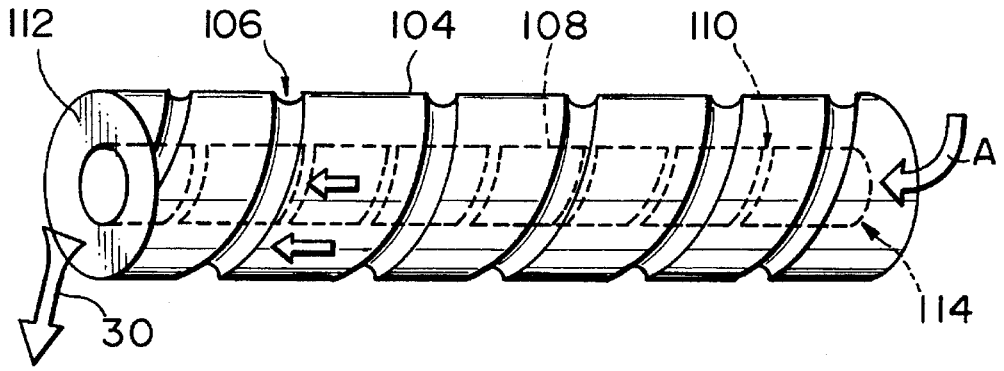
FIG. 7 shows another alternative embodiment of the toner cartridge and receptacle.
Figure 8:
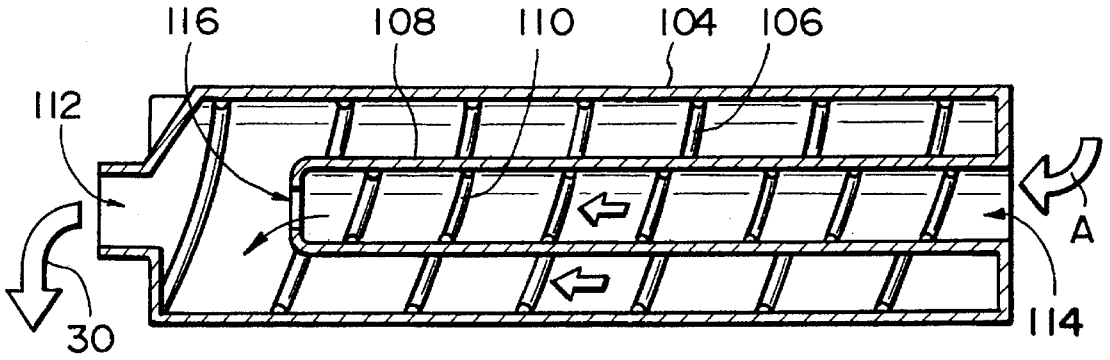
FIG. 8 is a section associated with FIG. 6.

FIG. 7 and 8 show another specific configuration of the cartridge and receptacle assembly. As shown, a toner cartridge 104 has a spiral ridge 106 while a tubular receptacle 108 has a spiral ridge 110 which extends in the same direction as the ridge 106. Further, the cartridge 104 has an outlet 112 at one end while the receptacle 108 has an inlet 114 at one end remote from the outlet 112 of the cartridge 104. In FIG. 8, the reference numeral designates an outlet formed in the receptacle 108 for introducing the collected developer into the cartridge 104. With this configuration, the cartridge 104 is capable of replenishing a fresh toner and collecting the used toner substantially at the center of rotation thereof. This further simplifies the structure of the cartridge 104.

Figure 9:
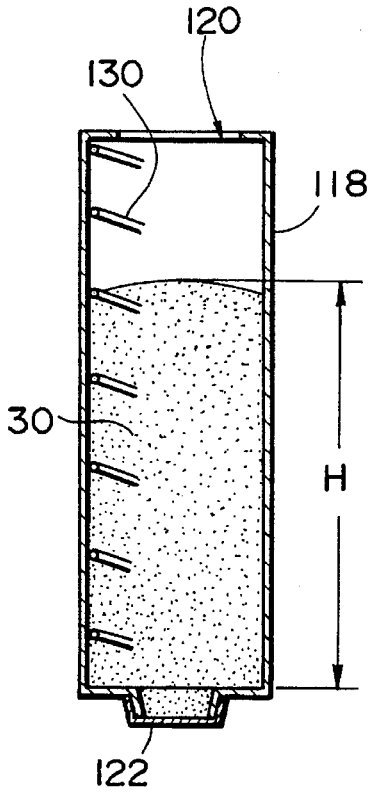
FIG. 9 is a section showing another alternative embodiment of the toner cartridge.
Figure 10:
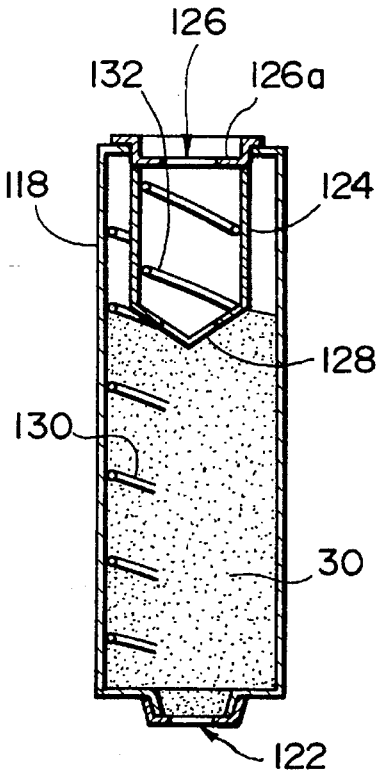
FIG. 10 is a section of a receptacle for collection disposed in the cartridge of FIG. 9.

FIGS. 9 and 10 show still another specific configuration of the cartridge and receptacle assembly. As shown, atoner cartridge 118 has an inlet 120 at the top and an outlet 122 at the bottom, while a receptacle 124 has an inlet 126 at the top and an outlet 128 at the bottom. The cartridge 118 and the receptacle 124 are respectively provided with spiral ridges 130 and 132 which extend in the same direction. The receptacle 124 is removably received in the cartridge 118 via the inlet 120 of the cartridge 118. The end of the receptacle 124 having the inlet 126 is so configured as to be capable of hermetically closing the inlet 120 of the cartridge 118.

Figure 11:
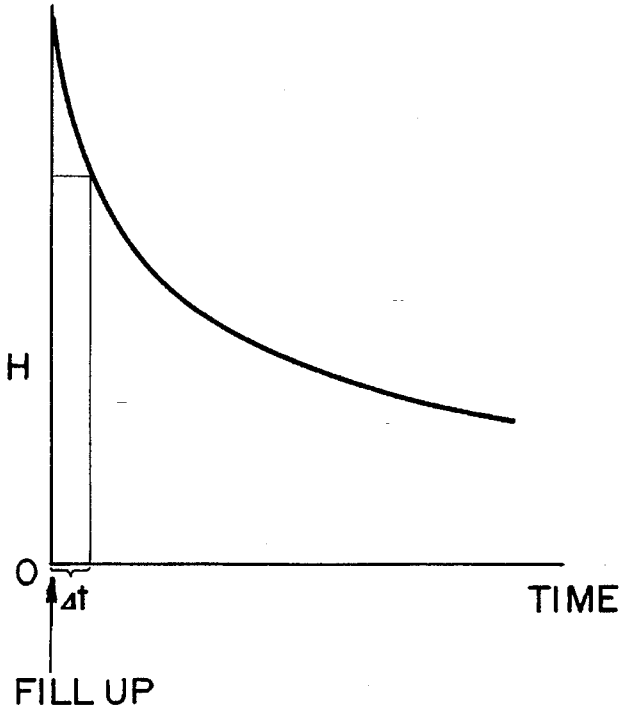
FIG. 11 is a graph showing how the apparent volume of a fresh developer changes after it has been filled in a toner cartridge.

To fill up the cartridge 118 with a fresh developer, the cartridge 118 is positioned upright, as shown in FIG. 9. Then, the developer 30 is introduced into the cartridge 118 via the inlet 120. Just after the filling up, the top of the developer 30 lowers, as shown in FIG. 11. As a result, a space great enough to accommodate the receptacle 124 is formed in the upper portion of the cartridge 118. As shown in FIG. 10, the receptacle 124 is mounted to the cartridge 118 such that the upper end **126*a* thereof sealingly stops the inlet 120 of the cartridge 118. Hence, it is possible to close the cartridge 118 without causing the developer from flying out when the receptacle 124 is mounted to the cartridge 118**.

Figure 12:
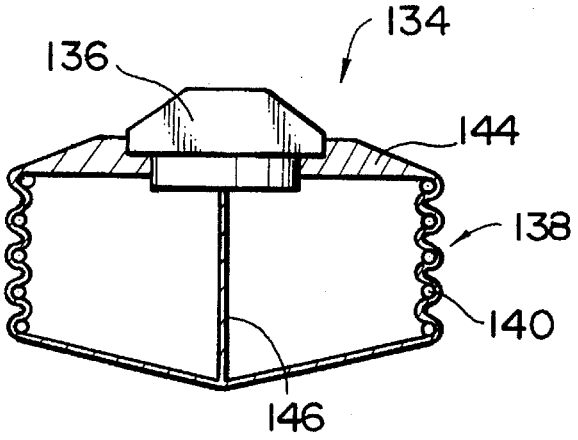
FIG. 12 is a section showing still another embodiment of the receptacle for collection.
Figure 13:
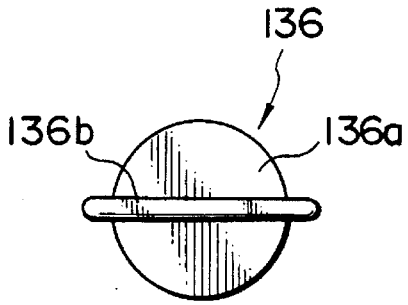
FIG. 13 is a plan view of a locking member attached to the receptacle of FIG. 12.
Figure 14:
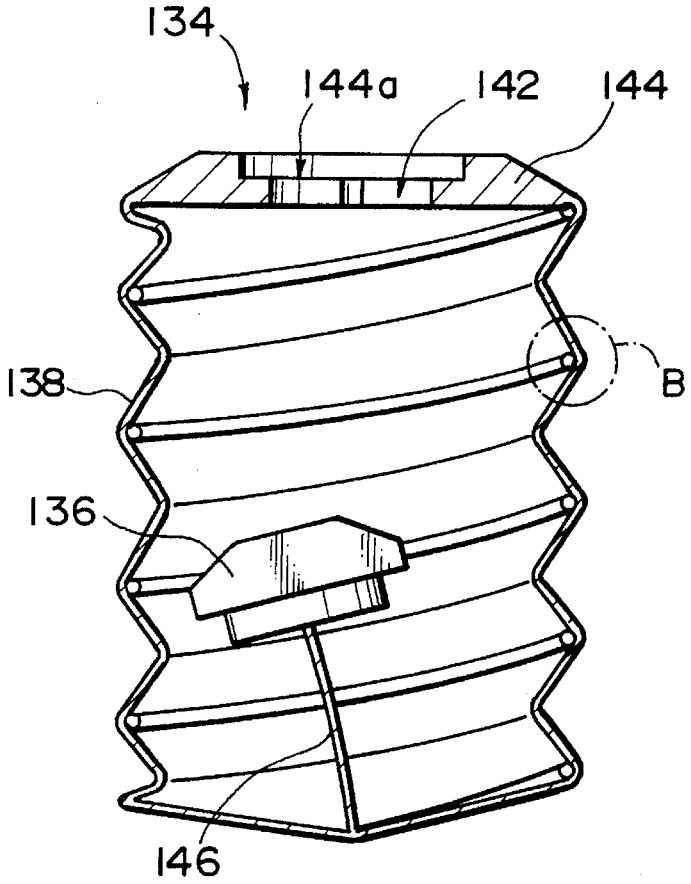
FIG. 14 is a section showing the receptacle of FIG. 12 in an expanded position.
Figure 15:
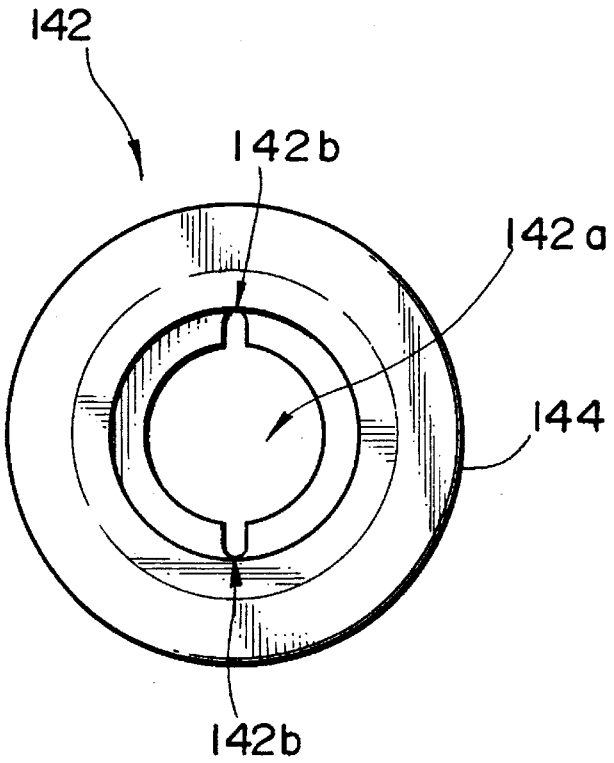
FIG. 15 is a plan view of the receptacle of FIG. 14.
Figure 16:
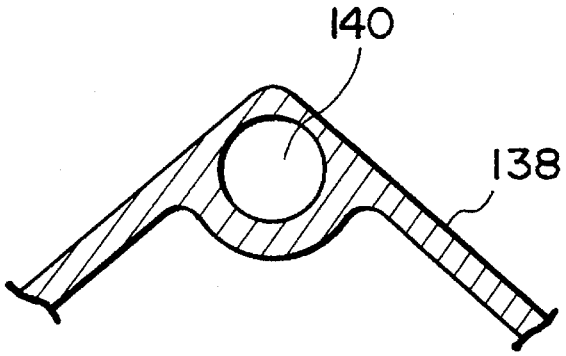
FIG. 16 is a fragmentary enlarged view associated with FIG. 14.

FIGS. 12–16 show a further specific configuration of the cartridge and receptacle assembly. As shown, a receptacle 134 is implemented as a flexible receptacle tending to expand due to the force of a spring or similar biasing member. A locking member 136 is engageable with the receptacle 134 to maintain it in a contracted position against the action of the biasing member. Specifically, a coiled compression spring 140, FIGS. 12 and 16, is received in a bellows 138 which is closed at the bottom thereof, thereby constantly biasing it to the expanded position. An end plate 144 is formed with an opening 142 and fitted on the top of the bellows 138. As shown in FIG. 15, the opening 142 is made up of a circular hole **142*a*, and two narrow notches 142*b* contiguous with the hole 142*a* and facing each other. As shown in FIG. 13, the locking member 136 has a disk 136*a* and a thumb piece 136*b* provided on the top of the disk 136a. A string or thread 146 is anchored at one end to the bottom of the locking member 136 and at the other end to the closed bottom of the bellows 138. The string 146** is made of a plastic.

Before the receptacle 134 is used, the bellows 138 is compressed, and the locking member 136 is engaged with a recess **144*a*, FIG. 14, formed in the end plate 144. As a result, the bellows 138 is held in the compressed position, as shown in FIG. 12. The receptacle 134 in such a compressed position is inserted into atoner cartridge, not shown (the resulting position is identical with the position shown in FIG. 10). Subsequently, the locking member 136 is rotated about 90 degrees until it meets the opening 142. Then, the string 146 is pulled by the bottom of the bellows 138 with the result that the locking member 136 drops into the bellows 138. Consequently, the bellows 138 expands and settles in the expanded position. In this condition, the developer can be collected in the receptacle 134**.

This embodiment provides the entire cartridge and receptacle assembly with a compact configuration.

In summary, a developer recycling system of the present invention has various unprecedented advantages, as enumerated below.

(1) When atoner end condition is reached, a developer is recirculated to and left in atoner cartridge by a recirculating device in substantially the same amount as a developer replenished into a developing device. Hence, when the cartridge is replaced, a predetermined amount of developer is automatically replaced. This eliminates the need for the periodic replacement of the developer.

(2) The recirculated developer is collected in an exclusive receptacle and prevented from being mixed with a fresh developer existing in the cartridge. As a result, sure replacement of the developer is promoted.

(3) Toner particles other than fatted particles and aggregated particles can be returned to the cartridge for reuse.

(4) The movement of the recirculated developer is enhanced to provide the receptacle with a small diameter, large capacity configuration.

(5) Moisture is absorbed not only from the carrier and toner of the recirculated developer but also from the fresh developer existing in the cartridge. This is successful in improving the fluidity and electrostatic property of the developer.

(6) The carrier included in the collected developer is trapped while the toner having sufficiently small diameters and not effecting image quality is selected. Hence, efficient reuse of the toner is promoted. In addition, it is possible to collect impurities, including the carrier and aggregated and fatted toner, efficiently without sacrificing easy operation.

Also, atoner cartridge and a developer collecting receptacle of the present invention have the following advantages.

(1) Both the fresh toner and the collected developer can be conveyed at the same time by a single drive source. As a result, the structure of a developer transferring section is simplified, not to speak of the overall structure. Further, the cartridge and receptacle have a compact axial size, compared to a unitary toner cartridge disclosed in previously mentioned Japanese Patent Laid-Open Publication No. 62-84049 or 2-33169.

(2) Since the developer is replenished and collected at one side of the cartridge, a measure against the leakage of the developer should only be provided at such an end.

(3) The developer can be replenished and collected substantially at the center of rotation of the cartridge, and the structure is simplified.

(4) The cartridge is compact and easy to pack and transport. In addition, the developer is prevented from flying out from the cartridge when it is to be sealingly closed.

(5) When a space for the agitation of the developer is to be provided before use, it is not necessary to subtract the volume of the receptacle from the volume of the cartridge. This provides the overall cartridge with a compact configuration.

Various modifications will become possible for those skilled in the art after receiving the teachings of the present disclosure without departing from the scope thereof.

What is claimed is:

1. A developer recycling system for replenishing a fresh developer to a developing device and collecting a used developer, comprising:

a developer cartridge filled with a fresh developer;

developer recirculating means for recirculating, when the fresh developer is replenished into a developing device in response to a decrease in density, a used developer which overflows said developing device to said developer cartridge;

said developer cartridge including an end wall and a tube extending from said end wall into an interior of said developer cartridge, and wherein said developer recirculating means is connected to said tube such that used developer enters said developer cartridge by way of said tube, and wherein said fresh developer is disposed in said developer cartridge outside of said tube; and wherein said tube is a receptacle which traps the used developer recirculated to said developer cartridge by said developer recirculating means, and wherein said receptacle has a mesh structure having a great number of micropores.

2. A developer recycling system for replenishing a fresh developer to a developing device and collecting a used developer, comprising:

a developer cartridge filled with a fresh developer;

developer recirculating means for recirculating, when the fresh developer is replenished into a developing device in response to a decrease in density, a used developer which overflows said developing device to said developer cartridge;

said developer cartridge including an end wall and a tube extending from said end wall into an interior of said developer cartridge, and wherein said developer recirculating means is connected to said tube such that used developer enters said developer cartridge by way of said tube, and wherein said fresh developer is disposed in said developer cartridge outside of said tube;

wherein said tube is a receptacle which traps the used developer recirculated to said developer cartridge by said developer recirculating means; and wherein a spiral groove is formed in an inner periphery of said receptacle in a direction opposite to a direction in which a spiral groove is formed in an inner periphery of said developer cartridge.

3. The device as claimed in claim 1, wherein a member for absorbing moisture from a carrier and atoner included in the used developer is accommodated in said receptacle.

4. The device as claimed in claim 1, wherein said micropores are sized to trap, among particles of the recirculated developer, particles greater than a predetermined particle size, but to pass particles smaller than a predetermined particle size.

5. The device as claimed in claim 1, wherein a spiral groove is formed in an inner periphery of said receptacle in a direction opposite to a direction in which a spiral groove is formed in an inner periphery of said developer cartridge.

6. A developer cartridge capable of replenishing a fresh developer to a developing device and collecting a used developer from said developing device at the same time, said cartridge comprising:

a container for replenishing a fresh developer to a developing device; and a receptacle formed integrally with said container for collecting a used developer;

said container including a hollow cylindrical body having a spiral ridge on a inner periphery thereof, said container further including an outlet at a first end;

said receptacle including a hollow cylindrical body having a spiral ridge on an inner periphery thereof, said receptacle further including an outlet at a first end and an inlet at a second end;

said receptacle being received in said container at an end wall of said container such that said receptacle and said container provide a double layer structure and such that said receptacle and said container are rotatable integrally about a substantially common axis, and wherein said spiral ridge of said container and said spiral ridge of said receptacle extend in a same direction as each other.

7. The cartridge as claimed in claim 2, wherein an outlet of said developer cartridge and an inlet of said receptacle are positioned at a same end of said developer cartridge.

8. The cartridge as claimed in claim 6, wherein said outlet of said container and said inlet of said receptacle are respectively positioned at opposite ends of said cartridge.

9. The cartridge as claimed in claim 6, wherein said receptacle is receivable in said container via an inlet of said container disposed at a second end of said container;

said second end of said receptacle being capable of sealingly closing said second end of said container.

10. The cartridge as claimed in claim 9, further comprising:

a biasing member for constantly biasing said receptacle such that said receptacle is flexible and tends to expand; and locking means engageable with said receptacle for maintaining said receptacle in a contracted position against a force of said biasing means.

11. A developer recycling system for replenishing a fresh developer to a developing device and collecting a used developer, comprising:

a developer cartridge having a fresh developer therein;

developer recirculating means for recirculating, when the fresh developer is replenished into a developing device in response to a decrease in density of a used developer, the used developer which overflows said developing device to said developer cartridge;

a receptacle for trapping the used developer recirculated to said developer cartridge by said developer recirculating means;

wherein said receptacle has a mesh structure having a great number of micropores.

12. A developer recycling system for supplying fresh developer to a developing device and receiving used developer from the developing device comprising:

a developer cartridge including an outer cylindrical body and an inner cylindrical body disposed inside of said outer cylindrical body, said inner cylindrical body extending from an end wall of said developer cartridge, said developer cartridge including a fresh developer disposed in said outer cylindrical body and between said outer cylindrical body and said inner cylindrical body; and recirculating means for feeding a used developer from a developing device to said inner cylindrical body of said developer cartridge;

wherein said inner cylindrical body has a shorter axial length than said outer cylindrical body.

13. A developer recycling system for supplying fresh developer to a developing device and receiving used developer from the developing device comprising:

a developer cartridge including an outer cylindrical body and an inner cylindrical body disposed inside of said outer cylindrical body, said inner cylindrical body extending from an end wall of said developer cartridge, Said developer cartridge including a fresh developer disposed in said outer cylindrical body and between said outer cylindrical body and said inner cylindrical body; and recirculating means for feeding a used developer from a developing device to said inner cylindrical body of said developer cartridge;

wherein said outer cylindrical body includes a fresh developer outlet disposed in said end wall.

14. A developer recycling system for supplying fresh developer to a developing device and receiving used developer from the developing device comprising:

a developer cartridge including an outer cylindrical body and an inner cylindrical body disposed inside of said outer cylindrical body, said inner cylindrical body extending from an end wall of said developer cartridge, said developer cartridge including a fresh developer disposed in said outer cylindrical body and between said outer cylindrical body and said inner cylindrical body; and recirculating means for feeding a used developer from a developing device to said inner cylindrical body of said developer cartridge:

wherein said end wall from which said inner cylindrical body extends constitutes a first end wall, said developer cartridge further including a second end wall, and further including a fresh developer outlet in said second end wall.

15. A developer recycling system for supplying fresh developer to a developing device and receiving used developer from the developing device comprising:

a developer cartridge including an outer cylindrical body and an inner cylindrical body disposed inside of said outer cylindrical body, said inner cylindrical body extending from an end wall of said developer cartridge, said developer cartridge including a fresh developer disposed in said outer cylindrical body and between said outer cylindrical body and said inner cylindrical body; and recirculating means for feeding a used developer from a developing device to said inner cylindrical body of said developer cartridge;

the system further including means for rotating said developer cartridge.

16. The developer recycling device of claim 15, further including a spiral ridge disposed on an inner surface of said outer cylindrical body and a spiral ridge disposed on an inner surface of said inner cylindrical body.

17. A developer cartridge comprising:

an outer cylindrical body having first and second end walls, and a fresh developer outlet disposed in one of said first and second end walls;

an inner cylindrical body extending from said first end wall into said outer cylindrical body, said inner cylindrical body including a Used developer inlet for receiving a used developer:

wherein said fresh developer outlet is disposed on said second end wall.

18. A developer cartridge comprising:

an outer cylindrical body having first and second end walls, and a fresh developer outlet disposed in one of said first and second end walls;

an inner cylindrical body extending from said first end wall into said outer cylindrical body, said inner cylindrical body including a used developer inlet for receiving a used developer;

wherein said fresh developer outlet is disposed on said first end wall.

19. The developer cartridge of claim 12, wherein said inner cylindrical body includes a used developer outlet at a location between said first and second end walls of said outer cylindrical body.

20. The developer cartridge of claim 12, further including a supply of fresh toner disposed between said outer cylindrical body and said inner cylindrical body.

21. The developer cartridge of claim 12, further including a spiral ridge disposed on an inner surface of said outer cylindrical body and a spiral ridge disposed on an inner surface of said inner cylindrical body.

22. A developer cartridge comprising:

an outer cylindrical body having first and second end walls, and a fresh developer outlet disposed in one of said first and second end walls;

an inner cylindrical body extending from said first end wall into said outer cylindrical body, said inner cylindrical body including a used developer inlet for receiving a used developer;

wherein said inner cylindrical body includes filter means for filtering used developer passing therethrough.

23. The developer cartridge of claim 18, wherein said inner cylindrical body includes a used developer outlet at a location between said first and second end walls of said outer cylindrical body.

24. The developer cartridge of claim 18, further including a supply of fresh toner disposed between said outer cylindrical body and said inner cylindrical body.

25. The developer cartridge of claim 18 further including a spiral ridge disposed on an inner surface of said outer cylindrical body and a spiral ridge disposed on an inner surface of said inner cylindrical body.

* * * * *